United States Patent [19]

Diedrich

[11] Patent Number: 4,973,109

[45] Date of Patent: Nov. 27, 1990

[54] FRONT KIT FOR VENDING MACHINES

[75] Inventor: Michael D. Diedrich, Madison Heights, Mich.

[73] Assignee: Fantastic Vending Inc., Rochester Hills, Mich.

[21] Appl. No.: 332,351

[22] Filed: Mar. 31, 1989

[51] Int. Cl.[5] ..... A47F 3/00

[52] U.S. Cl. ..... 321/114; 312/265.6; 194/350

[58] Field of Search ..... 312/265.6, 140, 204, 312/245, 114; 52/238.1; 16/1 R, DIG. 2; 40/312; 194/350

[56] References Cited

U.S. PATENT DOCUMENTS

| | | | |
|---|---|---|---|
| 2,520,506 | 8/1950 | Mankki | 312/245 |
| 2,871,081 | 1/1959 | Greene et al. | 312/114 |
| 3,056,639 | 10/1962 | Caminker et al. | 312/204 |
| 3,367,730 | 2/1968 | Andrews et al. | 312/204 |
| 3,408,127 | 10/1968 | Vincens | 312/204 |
| 3,500,649 | 3/1970 | Feldman | 312/291 |
| 3,953,093 | 4/1976 | Hero | 312/245 |
| 4,320,933 | 3/1982 | Felix et al. | 312/204 |
| 4,433,883 | 2/1984 | Boender et al. | 312/234.1 |
| 4,449,761 | 5/1984 | Davis et al. | 312/234.1 |
| 4,625,476 | 12/1986 | Shimada | 52/238.1 |
| 4,758,712 | 7/1988 | Matone, Jr. et al. | 312/208 |
| 4,804,877 | 2/1989 | Harwood | 312/114 |

*Primary Examiner*—Kenneth J. Dorner
*Assistant Examiner*—Brian K. Green
*Attorney, Agent, or Firm*—Harness, Dickey & Pierce

[57] ABSTRACT

Vending machines are provided with polycarbonate transparent protective covers for the front panels of the machines. A decorative pattern is provided between the protective cover and the front panel. Headers and kick plates can also be used in a bank of different vending machines to provide an aesthetically pleasing continuous presentation of a group of machines in a vending area that blends with the decor of the surrounding room.

15 Claims, 3 Drawing Sheets

FRONT KIT FOR VENDING MACHINES

BACKGROUND OF THE INVENTION

1. Technical Field

This invention relates to vending machines and, more particularly, to front kits for vending machines.

2. Discussion

Vending machines are in widespread use throughout the world. Despite their popularity, they are often subject to physical damaging abuse. While this damage sometimes occurs accidentally during transportation and installation, the primary culprit is the disgruntled user of a malfunctioning machine.

Traditionally, damaged machines are refurbished by replacing the abused front panel with new, but similarly constructed, metal front panels. Unfortunately, this is only a temporary cure since the replacement panels, like their original counterparts, are easily dented and damaged by the irate consumer.

Regardless of whether the machines are new or refurbished, their design often does not aesthetically blend well with the surrounding decor in the lunch room or other areas in which the machines are located. This unsightliness is further magnified when a row or bank of different machines are used next to each other.

SUMMARY OF THE INVENTION

In accordance with the teachings of the present invention, vending machines are provided with a protective cover that at least covers the front of the machine. The protective cover preferably is provided by way of a substantially transparent plastic sheet material. A decorative pattern on a given medium is sandwiched between the transparent outer layer and the front of the machine. The decorative pattern can be painted on a separate and replaceable painted sheet or it can be in the form of paneling. Alternatively, the inner surface of the transparent protective cover can be painted or wallpapered. The decorative pattern and other informational indicia on the machine are protected from abuse by the outer protective cover.

The present invention finds particular utility for use with a row of different reconditioned vending machines that are located in a designated vending room or alcove. Headers can be provided that fill the space between the tops of the machines and the ceiling of the room. The headers have decorative patterns that cooperate with the decorative patterns on the fronts of the machines to provide a continuous aesthetically pleasing presentation which blends well with the decor of the room. Removable kicker panels on the bottom of the machines can also be used to provide a continuous flow of the decorative pattern from the ceiling to the floor.

BRIEF DESCRIPTION OF THE DRAWINGS

The various advantages of the present invention will become apparent to those skilled in the art after reading the following specification and by reference to the drawings in which.

DESCRIPTION OF THE PREFERRED EMBODIMENT

Figure 1:
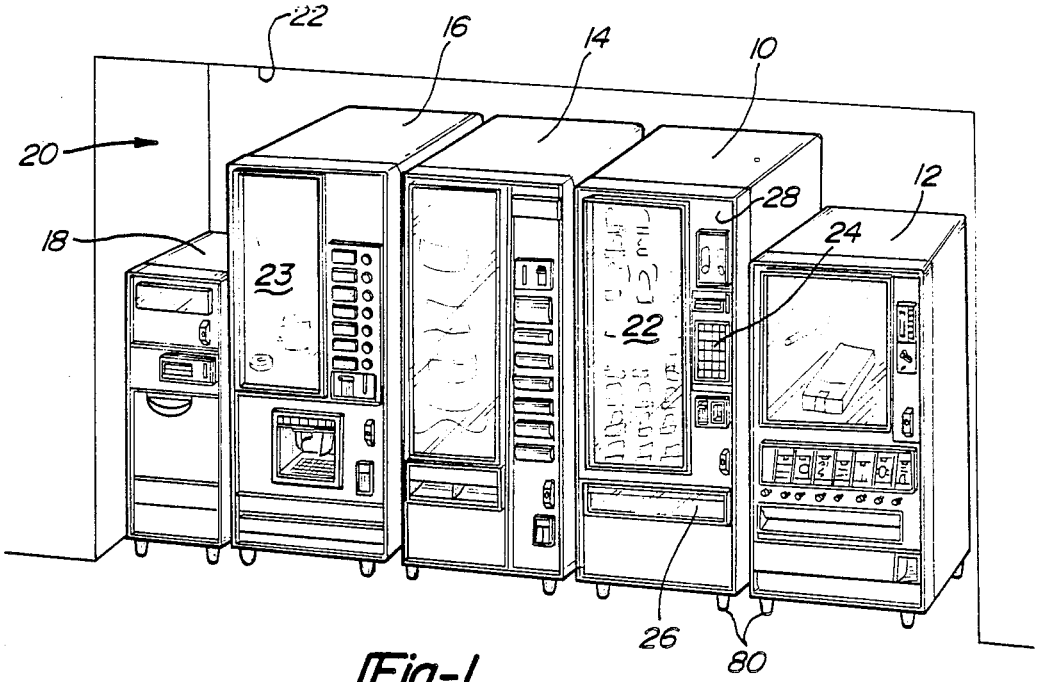
Fig-1 PRIOR ART
FIG. 1 is a perspective view of a row of vending machines before application of the techniques of the present invention.

FIG. 1 illustrates a typical presentation of a row of different vending machines 10-18 located in a three-sided room or alcove 20 having a ceiling 22. The type of product dispensed by each vending machine is of no real consequence to the present invention. Suffice it to say that a variety of different products are dispensed and each machine has its own characteristics but, as is typical, they have varying heights. Each machine generally includes some advertising indicia or a product viewing window designated, for example, by the reference numeral 22 on machine 10, as well as various selection switches 24, coin slots 25 and dispensing receptacles 26 for delivering the product to the customer. The typical vending machine includes a hinged metal door or front panel 28 that contains the aforementioned items, among other things. It is this front panel 28 that becomes dented, scratched and otherwise damaged over a period of time. Traditionally, the bank of machines do not aesthetically blend well with the decor in the room which may have painted, wallpapered or panelled walls.

Figure 2:
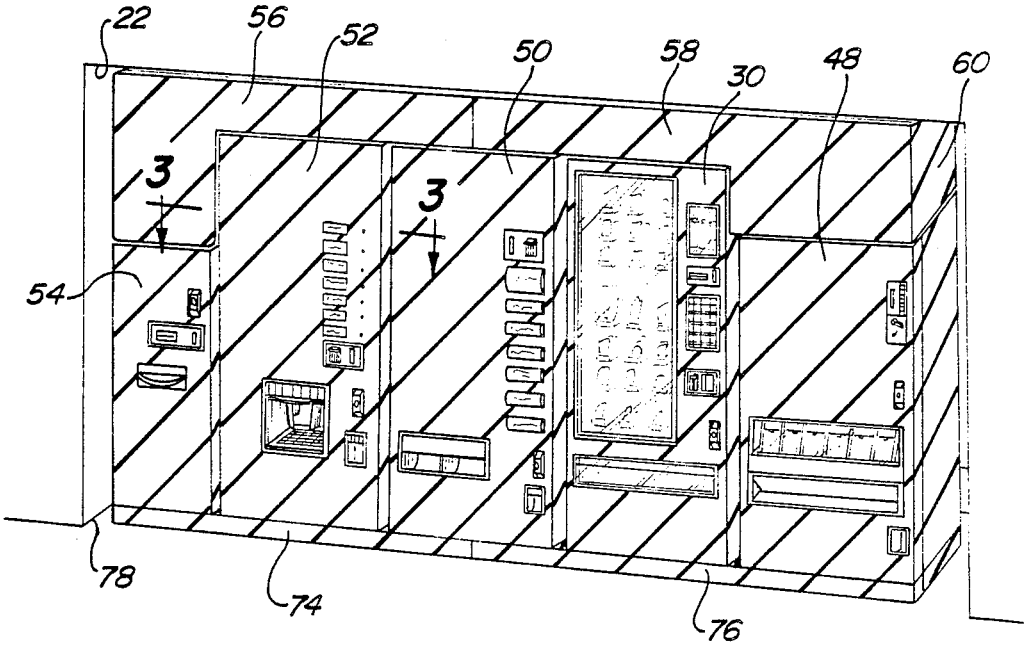
FIG. 2 is a perspective view of the vending machines in FIG. 1 after the application of the front kits of the present invention.
Figure 4:
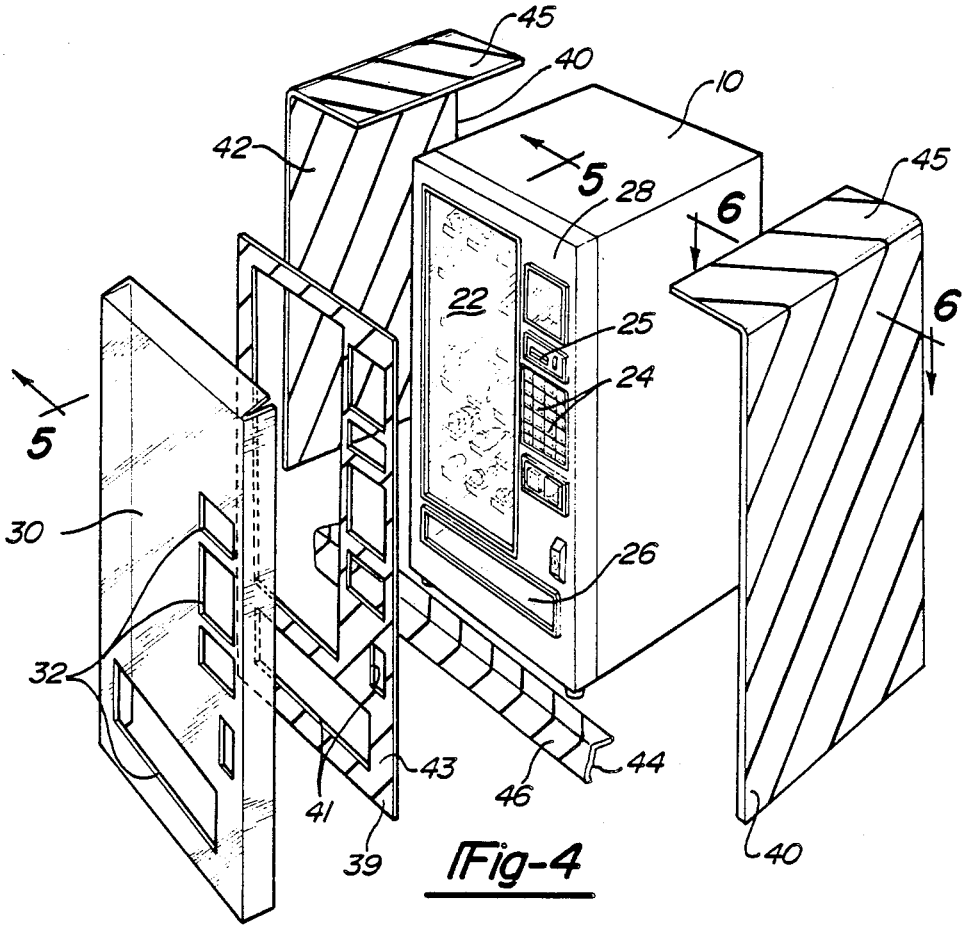
FIG. 4 is an exploded perspective view of a construction for refurbishing a single machine.

FIG. 2 illustrates an example of the vending machine area of FIG. 1 after application of the techniques according to the present invention. FIG. 4, on the other hand, illustrates the construction of a refurbished "stand alone" unit. There are many similarities to the techniques of the present invention regardless of whether plural units are used as in FIG. 2 or whether only a stand alone unit is used as in FIG. 4.

The front panel 28 of each machine is covered by a flat, transparent plastic protective cover 30. Trim or other protruding structures on the front panel are removed so that the cover can lie as flat as possible against the front panel 28. The protective cover is transparent so that the user can view requisite indicia on the front panel 28 or the products in the machine through window 22, as well as a decorative pattern which can be provided on a variety of different media as will be discussed hereinafter.

Figure 3:
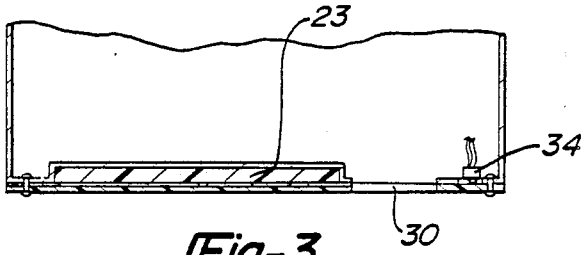
FIG. 3 is a partial cross-sectional view taken along the lines 3—3 of FIG. 2.
Figure 3A:
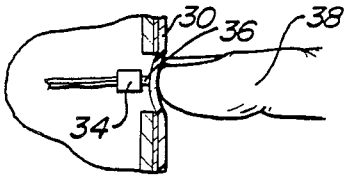
FIG. 3A is a partial cross-sectional view showing sufficient bending of the protective outer cover to activate a switch when pressed by a user.

The protective cover should be breakage and dent resistant. A presently preferred material is an acrylic resinous material, preferably a polycarbonate material such as that sold under the trademark LEXAN. It is commercially available in 4'×8' sheets and a thickness of 1/16–⅛inch can be used, although the 1/16 inch thickness is presently preferred. With sheets of these general dimensions, marginal edges of the cover can be folded at right angles as illustrated in the drawings by cutting and bending the edges in a fixture. Cut outs (generally designated by the numeral 32) can be provided as necessary to coincide with various areas on the front panel 28 such as the coin slot 25, selection switches 24, dispensing receptacle 26 and the like. Preferably, the number of cut outs are kept to a minimum to avoid dust-caching crevices. Openings need not be provided overlying certain types of selection switches 34 as shown in FIG. 3A. Some types of selection switches have plunger mechanisms 36 which can be depressed by the user by deforming the protective cover 30. The protective cover 30 is sufficiently pliable so that pressure by the human finger 38 is sufficient to depress the plunger 36 and activate the selection switch 34.

Figure 5:
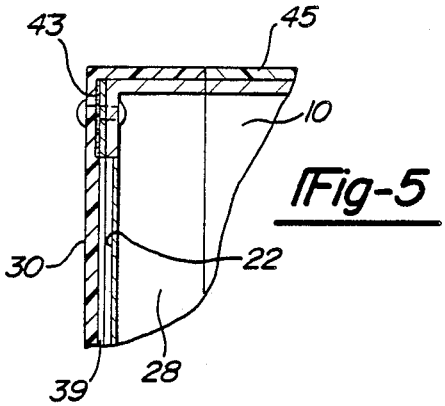
FIG. 5 is a partial cross-sectional view taken along the lines 5—5 of FIG. 4.
Figure 6:
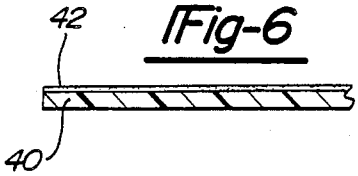
FIG. 6 is a partial cross-sectional view taken along the lines 6—6 of FIG. 4.

A decorative pattern is provided on a given medium sandwiched between the protective cover 30 and the front panel 28 of the machine. Two different medium are shown in FIGS. 4, 5 and 6. Preferably, the medium sandwiched between the front panel 28 and the front protective cover 30 is provided by way of a stamped metal sheet 39 having a number of cut outs 41 as necessary so as to not interfere with viewing or access to parts of the front panel 28. The front surface of the sheet 39 is painted with a decorative pattern generally designated by the numeral 43. A variety of different decorative patterns can be used but, in this example, the decorative pattern takes the form of a colored striped pattern running diagonally across sheet 39. Alternatively, the decorative pattern can take the form of wood paneling which would match the paneling in the surrounding room. The use of a painted metal sheet 39 for the front panel is preferred because it can be salvaged if it becomes necessary to replace the front cover 30 if it becomes damaged. Alternatively, as shown in FIG. 6, the inner surface of a side protective cover 40 can be directly painted with the decorative pattern 42. Side protective covers are normally not subject to the same abuse as the front of the machine and consequently, it should not be necessary to replace them as often. Nevertheless, either alternative technique can be used.

With a stand alone unit as shown in FIG. 4, the two side protective covers 40 are bent at right angles to provide top half-covers 45 for the top of the refurbished machine 10. The side protective covers 40 and the front protective cover 30 can be mounted to the machine 10 in a variety of manners such as by using a plurality of screws or the like. A kicker plate 44 with a coordinated pattern 46 thereon can also be used and removably attached to the legs of the machine 10 in the manner discussed below.

When a plurality of different machines are to be used in the manner shown in FIGS. 1 and 2, each of the machines is provided with a protective front cover with a decorative pattern that cooperates with the decorative patterns in the other front covers to provide a continuous aesthetically pleasing presentation. The machines are arranged so that their flat front covers all line up to provide the appearance of a continuous wall that blends with the decor on the walls of the room. Where a striped pattern is employed, the stripes can be arranged so that they match up in adjacent machines. The decorative pattern can alternatively take the form of wood paneling which is sandwiched between the protective outer covers and the machine. The paneling may match the paneling in the walls of the room so that the vending area blends well with the room decor and avoids being the usual eyesore that vending areas normally created. Another example would be to wallpaper the sheet 39 instead of painting it or to wallpaper the inner surface of cover 30 directly. Still other methods can be used while keeping within the spirit of this invention.

Figure 7:
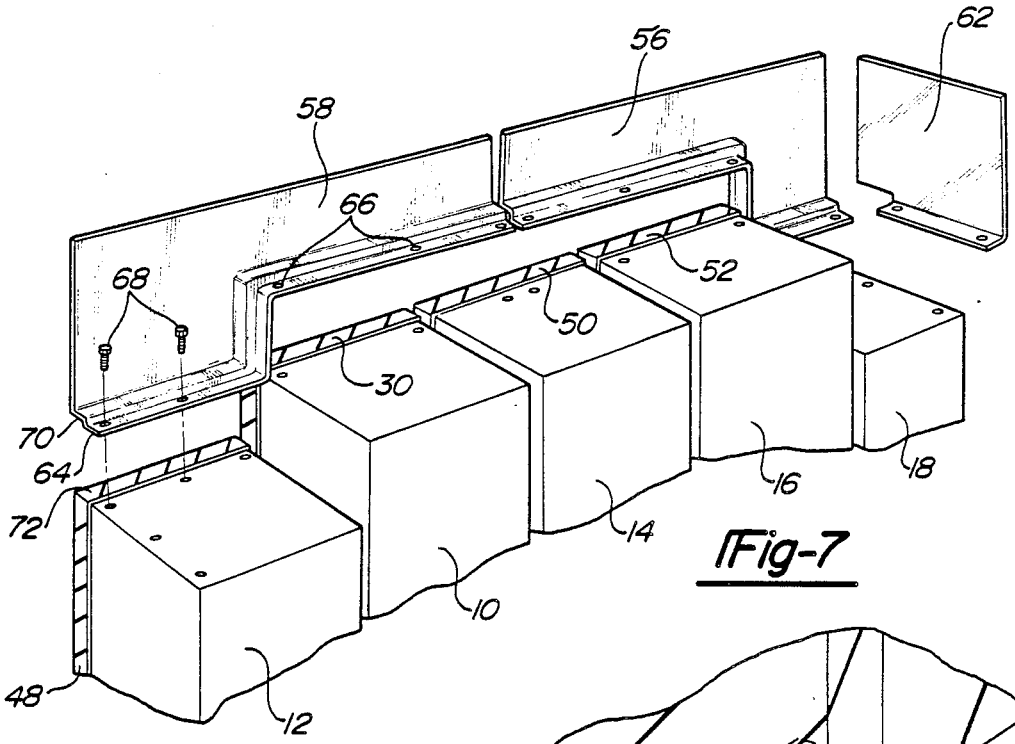
FIG. 7 is a partial perspective view taken from the rear of a row of vending machines showing connection of the headers thereto.

In FIG. 2, machine 10 is provided with protective front cover 30 (as previously discussed), machine 12 with protective cover 48, machine 14 with protective cover 50, machine 16 with protective cover 52 and machine 18 with protective cover 54. In this embodiment, it is not necessary for all of the side protective panels to be folded over to cover the tops of the machines as shown in FIG. 4 since the tops of the machines will be generally unseen due to the use of one or more headers 56 and 58. Side headers 60 (FIG. 2) and 62 (FIG. 7) can also be used to fill the space between the tops of the machines and the ceiling 22 in the vending room alcove. Each of the headers 56, 58 may include an in turned flange 64 including a plurality of openings 66 therein for receiving fasteners 68. The flange 64 can include an offset portion 70 which clears the marginal edges 72 of the front protective cover. When the fasteners 68 are tightened, the offset portion of the flange 64 serves to sandwich the marginal edges 72 against the top of the machines to hold the front protective covers in place.

Figure 9:
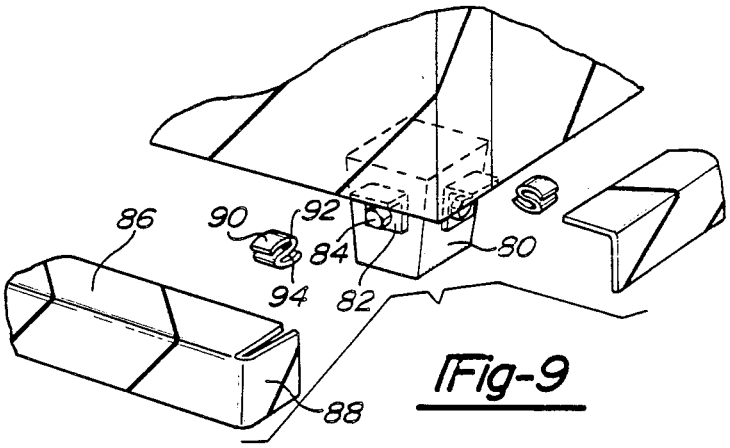
FIG. 9 is an enlarged exploded perspective view showing the kick plate connection in more detail.
Figure 8:
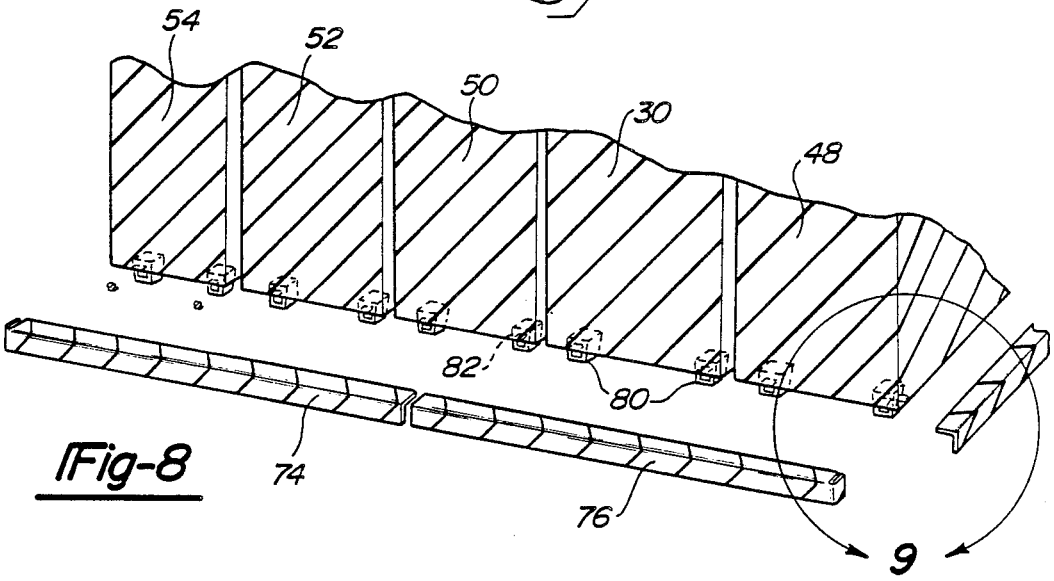
FIG. 8 is a partial perspective view illustrating the connection of kick plates to the bottoms of a row of vending machines.

Turning now to FIGS. 2, 8 and 9, a series of kicker plates 74 and 76 are used to fill the space between the bottom of the front panel 28 of the machines and the floor 78 of the vending alcove 20. Each machine has one or more feet 80 to which an L-bracket 82 is attached by way of fasteners 84. The kick plates 74, 76 each include a horizontal folded edge 86 and a vertically extending folded side edge 88. S-shaped clips 90 are used to removably attach the kick plates to the angle brackets 82. The S-shaped clips 90 have a pair of reversely curled loops 92 and 94. Loop 94 slips between the horizontally extending portion of the angle bracket 82. Loop 92, on the other hand, receives the horizontally extending folded edge 86 of the kick plate. This construction enables the kick plates to be easily removed for cleaning and other purposes, while also cooperating with the decorative patterns on the other protective panels and headers to provide an overall aesthetically pleasing structure which can be appreciated by a study of FIG. 2. The headers and the kick plates can both be made of the same polycarbonate sheet material as used for the front covers and the decorative patterns thereon can be painted, papered or otherwise applied to their inner surfaces.

The various advantages of the present invention will become apparent to those skilled in the art after having the benefit of studying the foregoing drawings and specifications as well as the following claims. For example, used vending machines can be refurbished using the techniques of this invention to provide the customer with a custom made vending area that is aesthetically coordinated with his existing decor. This can be done at relatively low cost by the vendor, especially when compared to the cost of new machines. Older machines operate quite efficiently but look bad. By way of this invention, cost-effective use of these older machines can be obtained, although it does have applicability to new machines as well since the original front panel design quite often does not appeal to the user. It should therefore be understood that various modifications can be made to the particular examples described herein without departing from the spirit and scope of this invention.

What is claimed is:

1. A vending machine comprising:

a front panel;

an auxiliary front protective cover for protecting the front panel, said auxiliary front protective cover being fitted on said vending machine, being substantially transparent and having one or more apertures for enabling access to the front panel of said vending machine; and an auxiliary medium sandwiched between the protective cover and the front panel of the vending machine, said auxiliary medium having a decorative pattern and one or more apertures for enabling access to the front panel of said vending machine.

2. The vending machine of claim 1 wherein the medium is positioned on an inner surface of the cover onto which the decorative pattern is directly applied.

3. The vending machine of claim 1 wherein said protective cover is a polycarbonate sheet having folded marginal edges covering corners of the machine.

4. The vending machine of claim 3 wherein said protective cover is sufficiently pliable that a user can activate a switch on the front panel of the machine by pressing an area of the sheet overlying the switch.

5. The vending machine of claim 1 which further comprises:

protective side covers having decorative patterns thereon coordinated with the decorative pattern on the front protective cover covering the front panel of the machine.

6. The vending machine of claim 5 wherein the machine has legs, and which further comprises:

a kick plate having a decorative pattern thereon coordinated with the decorative patterns on the front and side protective covers, said kick plates being removably attached to the legs.

7. The vending machine of claim 6 wherein the kick plates are removably attached to the legs by way of angle brackets attached to the legs and S-clips having a pair of reversely curled loops, one loop mounted to the angle brackets and another loop receiving a folded marginal edge of the kick plate.

8. A vending area comprising:

a row of vending machines;

each machine having an auxiliary protective cover covering at least a front panel of the machine, said auxiliary protective cover being fitted on said vending machine, being substantially transparent and having one or more apertures for enabling access to the front panel of the machine, and an auxiliary medium between the protective cover and the front panel of each machine, said auxiliary medium having a decorative pattern and one or more apertures for enabling access to the front panel of the machine, the decorative pattern being arranged and coordinated with decorative patterns on adjacent machines so that a substantially continuous aesthetically pleasing decorative pattern is provided.

9. The vending area of claim 8 wherein the machines are located in a room having a ceiling and which further comprises:

headers positioned adjacent said covers filling a space between tops of the machines and the ceiling of the room, the headers having decorative patterns coordinated aesthetically with the decorative patterns on the protective covers to thereby maintain the presentation of the continuous decorative pattern.

10. The vending area of claim 9 in which the protective covers have folded marginal edges lying on the tops of the machines, lower portions of the headers having a flange portion, and said headers and protective covers being mounted to the machines by fasteners extending through the flange of the headers into the machines.

11. The vending area of claim 10 which further comprises:

kick plates removably mounted to legs of the machines and having decorative patterns thereon cooperating with the decorative patterns on the protective front covers to maintain the presentation of the continuous decorative pattern.

12. The vending area of claim 8 wherein the protective cover is made of a 1/16–⅛inch thick sheet of polycarbonate material.

13. The vending area of claim 12 wherein the medium is a separate sheet to which the decorative pattern is applied.

14. The vending area of claim 12 wherein the medium is an inner surface of the sheet of polycarbonate material to which the decorative pattern is applied.

15. The vending area of claim 9 wherein the decorative pattern is wood paneling which matches wood paneling on walls of the room.

* * * * *